US006923317B2

(12) United States Patent
Coleman, Jr. et al.

(10) Patent No.: US 6,923,317 B2
(45) Date of Patent: Aug. 2, 2005

(54) MAGNETIC TOOL HOLDER

(75) Inventors: Edward S. Coleman, Jr., Ridgefield, CT (US); Stanley Stromski, Riverhead, NY (US)

(73) Assignee: Ullman Devices Corporation, Ridgefield, CT (US)

( * ) Notice: Subject to any disclaimer, the term of this patent is extended or adjusted under 35 U.S.C. 154(b) by 0 days.

(21) Appl. No.: 10/242,397

(22) Filed: Sep. 12, 2002

(65) Prior Publication Data

US 2004/0050735 A1 Mar. 18, 2004

(51) Int. Cl.[7] ..... B65D 85/20
(52) U.S. Cl. ..... 206/350; 206/378; 211/70.6
(58) Field of Search ..... 206/349, 350, 206/372–378; 211/70.6; 220/230

(56) References Cited

U.S. PATENT DOCUMENTS 3,111,736 A * 11/1963 Budreck ..... 24/303
4,802,580 A 2/1989 Andersen
5,228,570 A 7/1993 Robinson
5,316,143 A 5/1994 Horn
5,456,359 A 10/1995 Horn
5,501,342 A * 3/1996 Geibel ..... 206/378
5,544,747 A 8/1996 Horn
5,743,394 A 4/1998 Martin
5,896,729 A * 4/1999 Bell et al. ..... 206/722
6,006,906 A 12/1999 Winnard
6,073,766 A * 6/2000 Winnard ..... 206/378
6,092,655 A 7/2000 Ernst
6,095,329 A 8/2000 Kao
6,098,799 A 8/2000 Lee
6,571,669 B2 * 6/2003 Benatz et al. ..... 206/378
6,571,966 B1 * 6/2003 Hsiao ..... 211/70.6
6,614,337 B1 * 9/2003 Winnard ..... 206/350

* cited by examiner

*Primary Examiner*—Luan K. Bui
(74) *Attorney, Agent, or Firm*—Bachman & LaPointe, PC

(57) ABSTRACT

A magnetic tool holder includes a body portion having an elongate central portion defining a channel and having side edges laterally extending from the central portion in a plane; and a magnet member disposed in the channel and having a tool securing surface positioned in the plane.

8 Claims, 2 Drawing Sheets

MAGNETIC TOOL HOLDER

BACKGROUND OF THE INVENTION

The invention relates to a magnetic tool holder and, more particularly, to a magnetic holder for sockets and similar tools which can advantageously secure various different types, sizes and shapes of ferrous tool components.

Tool holders such as socket wrench holders and the like are used for organizing socket wrenches and components thereof, and such tools are typically used in a wide variety of fields such as automobile repair, home repair and the like.

Various different types of socket holders include attachment structures which are difficult to manipulate with a single hand, and further are positioned in cases, tool boxes or various other structures which can only be positioned on flat surfaces. These issues make the use of such tools difficult under certain circumstances, and it is therefore clear that the need remains for improved devices for releasably holding tools and tool components for convenient access by the tool user.

It is therefore the primary object of the present invention to provide a magnetic tool holder which is readily adaptable to holding tools and tool components having a wide variety of shapes and sizes.

It is a further object of the present invention to provide such a holder wherein tools and tool components can be positioned on and removed from the holder with a single hand.

It is a further object of the present invention to provide such a holder which can be positioned in a more versatile array of positions for further ease of use by the tool users.

Other objects and advantages of the present invention will appear hereinbelow.

SUMMARY OF THE INVENTION

In accordance with the present invention, the foregoing objects and advantages have been readily attained.

According to the invention, a magnetic tool holder is provided which comprises a body portion having an elongate central portion defining a channel and having side edges laterally extending from said central portion in a plane; and a magnet member disposed in said channel and having a tool securing surface positioned in said plane.

BRIEF DESCRIPTION OF THE DRAWINGS

A detailed description of preferred embodiments of the present invention follows, with reference to the attached drawings, wherein.

DETAILED DESCRIPTION

The invention relates to a magnetic tool holder which advantageously can magnetically secure sockets and other ferrous tools, whereby the shape and size of the tools is not an obstruction to securing such tools on the holder, wherein the tools are easily released from the tool holder in a single-handed maneuver, and wherein the holder itself can be securely positioned to any ferrous support surface, be it horizontal or otherwise.

In addition, the magnet and body portion structure of the tool holder as will be described below greatly enhances the magnetic holding ability of the tool holder such that sockets, wrenches and the like are securely held on the holder.

Figure 1:
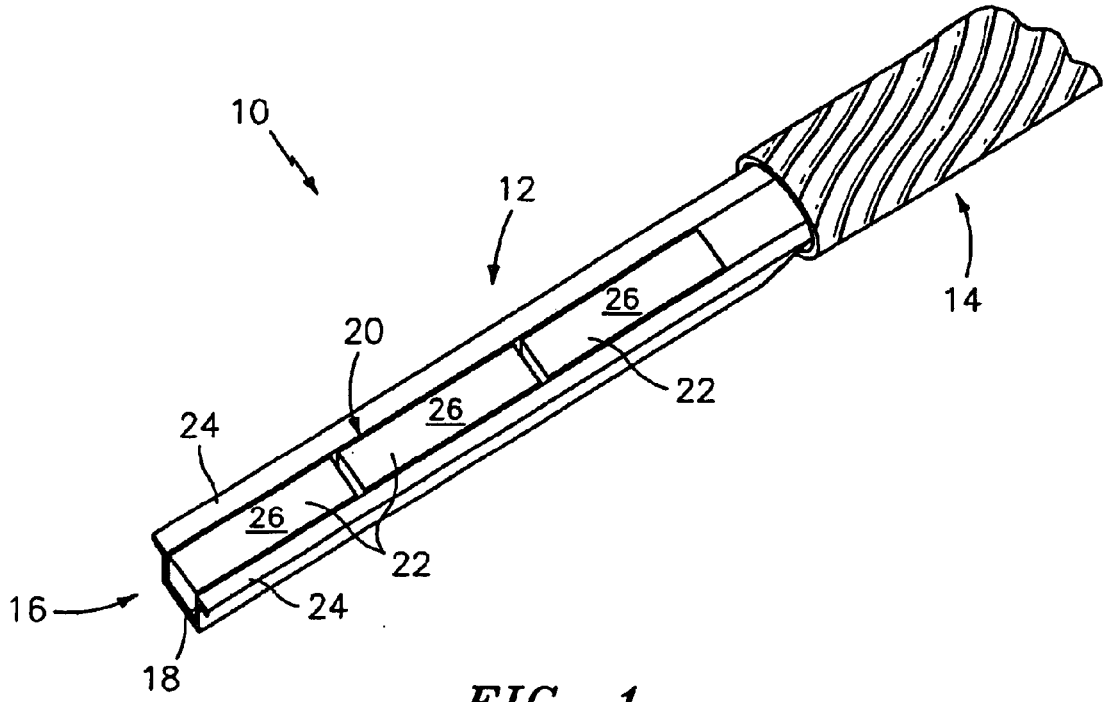
FIG. 1 is a perspective illustration of a magnetic tool holder in accordance with the present invention.

Referring to FIG. 1, a magnetic tool holder 10 is illustrated and, in accordance with the present invention, includes a body portion 12 and a handle member or grip member 14.

Body portion 12 is an elongate member preferably having a central portion 16 which defines a channel 18 for holding a magnet member 20 which is preferably a series of magnets 22 positioned along channel 18.

In further accordance with the present invention, body portion 12 also has side edges 24 which extend laterally from central portion 16 in a plane. Magnet member 20, and magnets 22 thereof, are preferably substantially flat magnets having surfaces 26, preferably planar surfaces, which are advantageously positioned in a plane with side edges 24. This is further illustrated in FIGS. 2–4.

Body portion 16 is further advantageously provided of a ferrous material, and magnet member 20 in accordance with the present invention advantageously polarizes side edges 24 such that side edges 24 and surfaces 26 define a combined tool securing surface upon which various ferrous objects such as sockets, socket wrenches and the like can be magnetically supported.

Positioning of surfaces 26 of magnets 22 and side edges 24 in the same plane is particularly advantageous in accordance with the present invention in that this positioning serves to increase the surface area in contact with a substantially flat ferrous member to be secured, thereby enhancing the magnetic hold of same on tool holder 10 as desired.

Figure 2:
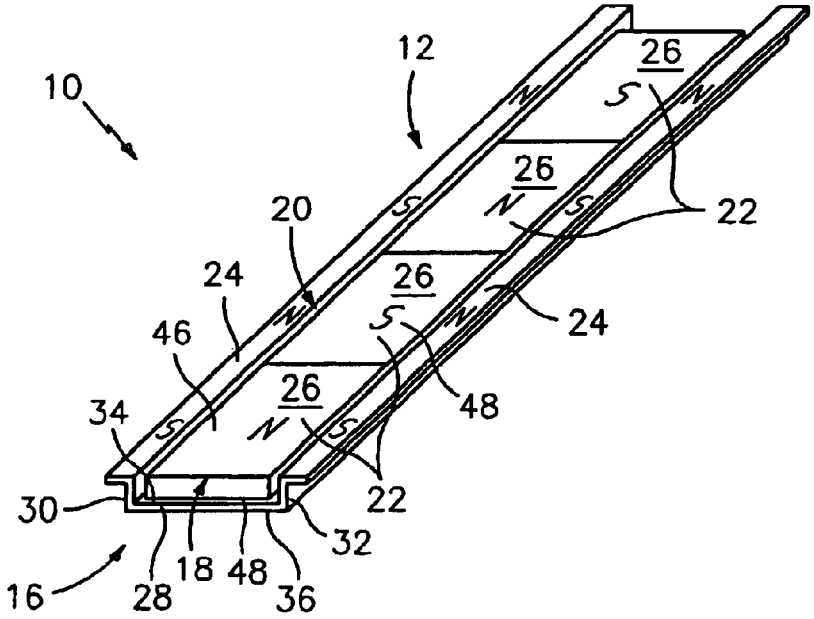
FIG. 2 is a perspective view of a portion of a magnetic tool holder in accordance with the present invention.
Figure 3:
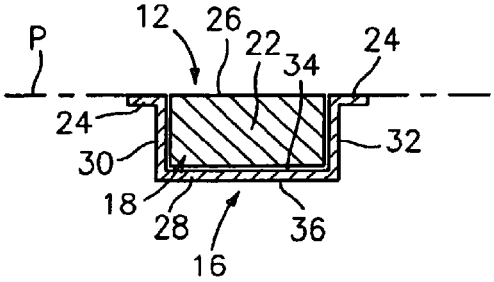
FIG. 3 is a cross section taken through magnetic tool holder in accordance with the present invention.

Referring also to FIGS. 2 and 3, it can readily be seen that body portion 12 is advantageously defined by a formed elongate rail or track member having central portion 16 defined by a bottom wall 28 and two side walls 30, 32. Bottom wall 28 and side walls 30, 32 collectively define the three sides of channel 18 for holding magnet member 20 in accordance with the present invention. As further illustrated in FIGS. 2 and 3, side edges 24 extend laterally away from side walls 30, 32 in plane P as desired.

From FIG. 3, it should be appreciated that wall 28 has a magnet-facing surface 34 and a rear-facing surface 36. In accordance with the present invention, it has been found that magnet member 20 positioned in channel 18 further serves to polarize rear surface 36 which advantageously allows for securing of holder 10 to any flat ferrous support surface. The magnetic nature and hold thereby provided advantageously serve to allow for holder 10 to be positioned on non-horizontal surfaces, which can greatly facilitate the accessibility of tools to a user of such tools in certain jobs wherein convenient positioning of a conventional tool box would be difficult.

Figure 5:
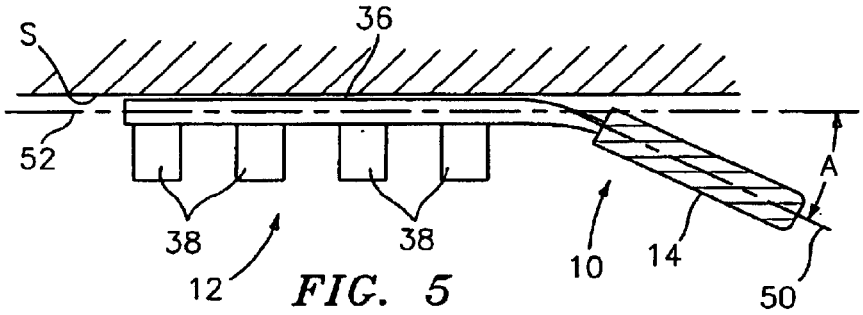
FIG. 5 illustrates a magnetic tool holder in accordance with the invention in a field of use.

In further accordance with the present invention, and as illustrated in FIG. 5, various tool components 38 when secured to holder 10 in accordance with the present invention have been found to further enhance the flux or polarization of rear surface 36 such that the holding ability of holder 10 to remain secure to a flat surface S increases as the number of ferrous objects held on tool securing surface 26 increases. Thus, holder 10 in accordance with the present invention can readily and advantageously be positioned on downwardly facing surfaces such as surface S as illustrated in FIG. 5.

It should of course be appreciated that rear surface 36 of holder 10 in accordance with the present invention could alternatively be utilized to hold additional tool components 38 if desired, thereby increasing the capacity of holder 10. Of course, in such a configuration, rear surface 36 would be used for storing such tool components rather than securing holder 10 to a ferrous surface.

Figure 4:
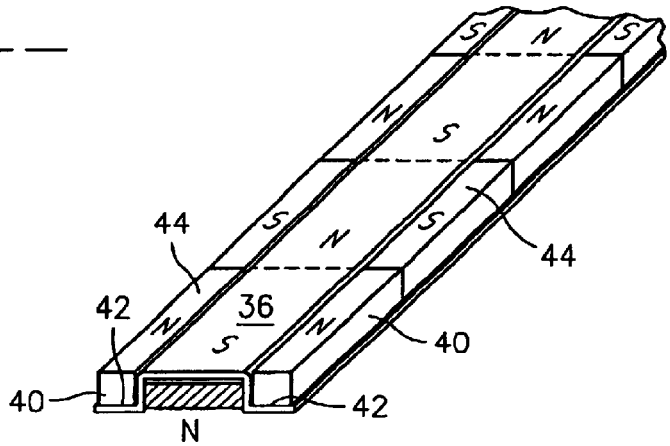
FIG. 4 is a rear-perspective view of an alternative embodiment of a magnetic tool holder in accordance with the present invention.

Turning now to FIG. 4, an alternative embodiment of the present invention is illustrated wherein additional magnets 40 are positioned on rear or back surfaces 42 of side edges 24. Additional magnets 40 advantageously serve to increase the polarization of the tool securing surface side of side edges 24, and further serve to enhance the hold of holder 10 to a ferrous surface such as the position illustrated in FIG. 5. In this embodiment, additional magnets 42 have rear facing surfaces 44 which are advantageously positioned in a substantially co-planar position with rear surface 36 of body portion 12.

Turning now to FIG. 2, it is preferred in accordance with the present invention for magnets 22 to be provided having opposed surfaces 46, 48, wherein such surfaces 46, 48 correspond with north and south poles, respectively, of each magnet. It is further preferred in accordance with one embodiment of the present invention to position magnets 22 with poles and corresponding surfaces 46, 48 alternating along channel 16 as shown in FIG. 2. Positioning of magnets 22 in this fashion allows interaction of opposite surfaces of magnets in adjacent pairs of magnets and has been found in accordance with the present invention to still further increase the flux or holding power of holder 10 in accordance with the present invention. Also as illustrated in FIG. 2, positioning of magnets 22 in channel 18 serves to polarize side edges 24, and thereby increases the number of different poles which are present along the entire tool securing surface of holder 10. This is advantageous in that the greater the number of poles defined in the tool securing surface, the greater the flux or tool holding ability.

It should of course be noted that additional magnets 42 as positioned in accordance with the embodiment of FIG. 4 are preferably likewise also arranged in alternating fashion, with north and south pole surfaces alternating along the length of body portion 12.

It should be noted that although FIGS. 1, 2 and 4 show various different number of magnets 22, any number of magnets can be positioned along channel 18 within the broad scope of the present invention. Further, although magnets 22 are shown substantially adjacent to each other along channel 18, magnets can be spaced, instead, if desired. It is preferred, however, that magnets be positioned substantially adjacent to each other since such positioning enhances the flux and holding power of same.

Turning now to FIG. 5, handgrip member 14 is shown in a preferred configuration wherein handgrip portion 14 extends along an axis 50 which is not co-linear or planar relative to an axis 52 of body portion 12. This advantageously serves to allow for ease in grasping handgrip member 14 even when holder 10 is secured to a surface S as shown in FIG. 5. In accordance with this aspect of the present invention, it is preferred that handgrip member 14 be positioned at an angle A relative to axis 52 which is between about 10 and about 35°.

Figure 6:
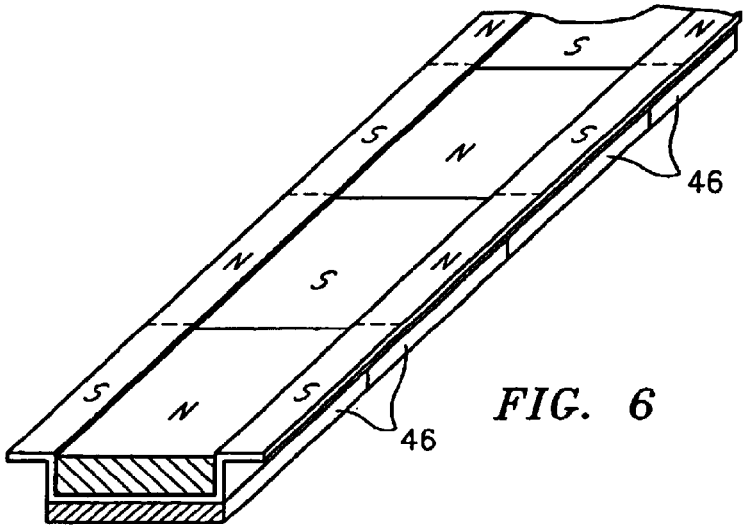
FIG. 6 is a perspective illustration of a magnetic tool holder in accordance with an alternative embodiment of the present invention.

Turning now to FIG. 6, a further alternative embodiment in accordance with the present invention is illustrated. In this embodiment, additional magnets 46 are positioned along rear surface 36 of body portion 12. Additional magnets 46 can further serve to enhance the holding ability of holder 10 in securing to a ferrous surface for storage. In this regard, additional magnets 46 are preferably also substantially flat magnets having north and south polar surfaces, and these surfaces are preferably aligned so as to alternate relative to surfaces of magnets 22 positioned within channel 18. This further serves to enhance the flux defined in both holding surfaces, thereby providing enhanced holding power for tools and/or securing to ferrous surfaces as desired in accordance with the present invention.

Magnets 22 in accordance with the present invention can be any of a wide variety of magnets which are available and well known to a person of ordinary skill in the art. Such magnets can be secured in channel 18 through various adhesives, fasteners and the like, and are further held within channel 18 by magnetic attraction to the ferrous material from which body portion 12 is preferably made.

It should be appreciated that a tool holder has been provided in accordance with the present invention which readily accomplishes the various objectives set forth above, and which advantageously provides for convenient storage and access of ferrous tools such as socket wrench attachments and the like. Further, the magnetic tool holder of the present invention is relatively simple and inexpensive in manufacture, and also provides for greatly enhanced versatility and positioning on various ferrous surfaces, which greatly increases the usability to mechanics and other users of the tools held thereby.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A magnetic tool holder, comprising:

a body portion having an elongate central portion defining a channel and having side edges laterally extending from said central portion in a plane; and a magnet member disposed in said channel and having a tool securing surface positioned in said plane, wherein said magnet member comprises a plurality of magnets each having opposed flat surfaces defining north and south pole surfaces, and wherein said magnets are positioned along said channel with alternating north and south pole surfaces defining said tool securing surface.

2. The apparatus of claim 1, wherein said body portion comprises a ferrous material and has a back surface opposite from said plane, whereby said back surface is polarized by said magnet member so that said back surface can be releasably secured to a ferrous support surface.

3. The apparatus of claim 1, wherein said side edges have a tool securing surface arranged in said plane, and opposed rearwardly facing surfaces, and further comprising an additional magnet member adjacent to said rearwardly facing surfaces.

4. The apparatus of claim 2, wherein said side edges have a tool securing surface arranged in said plane, and opposed rearwardly facing surfaces, and further comprising an additional magnet member adjacent to said rearwardly facing surfaces.

5. The apparatus of claim 4, where in said additional magnet member has rearwardly facing back surfaces, and wherein said rearwardly facing back surfaces are coplanar with said back surface of said body portion.

6. The apparatus of claim 1, further comprising a handgrip member extending from said body portion.

7. The apparatus of claim 6, wherein said handgrip member extends in an axis which is offset with respect to an axis of said body portion.

8. The apparatus of claim 1, wherein said body portion comprises a ferrous material and has a back surface opposite from said plane, and further comprising an additional magnet member positioned on said back surface.

* * * * *